United States Patent [19]

Mabrouk

[11] 4,029,008

[45] June 14, 1977

[54] MOISTURE CONTROL SYSTEM

[75] Inventor: Saied Abd-Elrahman Mabrouk, Macedonia, Ohio

[73] Assignee: Addressograph Multigraph Corporation, Cleveland, Ohio

[22] Filed: May 24, 1976

[21] Appl. No.: 689,165

[52] U.S. Cl. ..... 101/148

[51] Int. Cl.[2] ..... B41F 7/26; B41F 7/36; B41L 25/02; B41L 25/14

[58] Field of Search ..... 101/148, 147, 349, 350, 101/363, 365, 206, 207, 208, 209

[56] References Cited

UNITED STATES PATENTS

| | | | |
|---|---|---|---|
| 3,191,528 | 6/1965 | Jorgensen | 101/148 |
| 3,412,677 | 11/1968 | Kantor | 101/148 |
| 3,499,383 | 3/1970 | Southam | 101/148 |
| 3,835,774 | 9/1974 | Heidt | 101/148 |
| 3,937,141 | 2/1976 | Dahlgren | 101/148 |

*Primary Examiner*—J. Reed Fisher
*Attorney, Agent, or Firm*—Harry M. Fleck, Jr.

[57] ABSTRACT

A moisture system is provided for a lithographic duplicator comprising means for controlling the rate at which moisture is supplied to the master as a function of speed of a hydrophilic roll driven by an ink-receptive roll in contact with the master cylinder. The control means also utilize reference signals, indicative of duplicator speed, to the control moisture supply rate.

23 Claims, 6 Drawing Figures

+15V.
50
C1
48
+15V.
60
62
56
C2
64
+24V.
54
52
46
ONE-SHOT
+15V.
36
ONE-SHOT
+15V.
32
42
82
80
ON
OFF
78
+24V.
20
M
70
72
76
74
68
ONE-SHOT
+15V.
58
66

MOISTURE CONTROL SYSTEM

BACKGROUND OF THE INVENTION

This invention relates to lithographic duplicating and especially to the control of moisture application to the master during printing.

The problem of moisture control has been a persistent one, and many different types of moisture application systems have been developed with varying degrees of success. One fairly standard construction employs molleton covered rolls which are moisture absorptive and provide a reservoir situation which proves rather effective under the control of a trained operator, but in the hands of untrained people can be difficult to manage. For example, a slightly low moisture setting will eventually cause the molletons to dry out and ultimately ink up which requires a complex molleton changing procedure, and excessively high moisture setting, on the other hand, will eventually cause the molletons to become over-wet and necessitates delaying printing operations until they can be dried out sufficiently to proceed. In addition, of course, molleton covers present the familiar built-in problems of lint production and a tendency to irregularity of the roll surface.

A number of moisture systems which are free of molleton coverings (and of the attendant reservoir effects) have been developed, and while they escape the above-mentioned drawbacks, they are still significantly reliant upon trained operator control because of their sensitivity. That is to say, very slight changes in adjustment, or changes in moisture demand the master environmental conditions of humidity, run length, ink temperature or condition due to previous running or non-running, can cause the moisture situation to shift quickly either to a low moisture or to an over-wet condition with the result that copies are damaged and time can be lost in restabilizing the system, unless a skilled alert operator is available to prevent the condition from maturing unduly, or to reestablish correct operating conditions quickly once the aberration is recognized.

SUMMARY OF THE INVENTION

It is a primary object of the present invention to provide a moisture control system which overcomes the drawbacks of the above-described systems and which maintains moisture at a suitable level for producing copies of acceptable quality. Moisture stability is maintained over a range of operating conditions and without operator intervention, once the basic reference levels have been properly adjusted and set.

This is achieved through the use of a moisture supply control which, in the preferred embodiment, varies the fountain roll speed and thus the rate at which moisture is introduced into the system. The moisture balance is sensed by observing the speed of hydrophilic roll driven by an ink-receptive roll carrying a thin film of lithographic ink by reason of direct or indirect contact with the master surface. The ink-receptive roll is power driven in time with the master cylinder by appropriate linkage such that the surface speeds have a substantially constant relationship. The hydrophilic roll is driven solely by contact of its surface with that of the ink-receptive roll. Driving forces are created on the hydrophilic roll due to the sheer resistance of the intervening layers of ink and moisture between the two rolls.

In one embodiment of the invention moisture is fed to the master via the hydrophilic roll, the speed of which is governed by an appropriate mechanism applying a restraining torque which increases monotonically with speed. Moisture is applied to the hydrophilic roll from a moisture fountain roll via appropriate means such as a ductor roll.

It has been found that the rotational speed of the hydrophilic roll is an inverse function of the amount of moisture at the nip with the ink-receptive roll. Thus, as the moisture increases the hydrophilic roll slows down due to slippage, and vice versa. This change in speed is sensed by appropriate means and a corresponding speed signal is provided to a feedback circuit which increases or decreases the speed of the fountain roll, as the conditions demand. It has also been found that while the speed of the hydrophilic roll increases with machine speed, the relationship is not necessarily linear. Therefore, the control circuitry utilizes reference signals indicative of machine speed to further control the speed of the fountain roll. This results in a highly responsive moisture control system which operates with a high degree of stability over a wide range of conditions.

In a second embodiment of the invention, the moisture is supplied to the master via means separate from the hydrophilic roll. The moisture in the system migrates to the hydrophilic roll via the ink-receptive roll to provide an ink/moisture emulsion at the interface of the two rolls which controls the speed of the hydrophilic roll as described above. Signals indicative of rotational speed of the hydrophilic roll are provided to the feedback control circuit described above to control speed of the fountain roll or other moisture supply means.

It is an object of the present invention to provide a versatile duplicator moisture control which maintains proper moisture levels necessary to produce quality copies and being effective over a wide range of conditions without operator intervention.

Another object of the present invention is to provide a novel duplicator moisture control comprising feedback circuitry for controlling the rate at which moisture is applied to the master cylinder as a function of rotation of a moisture sensing roll.

It is a further object of the present invention to provide a unique moisture control comprising circuitry for controlling the speed of a moisture fountain roll as an inverse function of the moisture sensed in the duplicator system.

Yet another object of the present invention is to provide a versatile duplicator moisture control comprising means for controlling the amount of moisture supplied to a master as a function of the rotation of a moisture sensing roll and the speed of the duplicator.

BRIEF DESCRIPTION OF THE DRAWINGS

FIG. 3 is a schematic diagram of the moisture control circuit shown in FIG. 2;

DESCRIPTION OF THE PREFERRED EMBODIMENT

Figure 1:
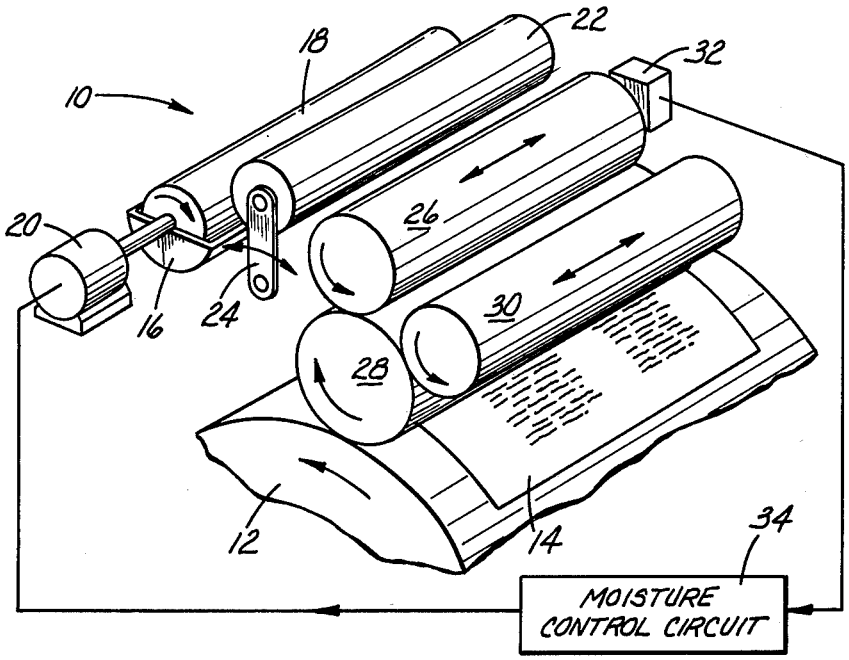
FIG. 1 is a diagrammatic illustration of the moisture control system of the present invention.

Referring now, more particularly, to FIG. 1 of the drawings, the moisture control system of the present invention is generally indicated by the numeral 10 and is mounted in operative engagement with a master cylinder 12 of a lithographic duplicator. A master 14 is mounted to cylinder 12 for producing copies by well-known lithographic processes. The moisture system includes a fountain 16 having a fountain roll 18 with a hydrophilic surface. An appropriate drive motor 20 rotates the fountain roll at a speed determined by the moisture control circuit, as hereinafter described. A ductor roll 22 is mounted on an oscillating arm 24 for movement by a conventional mechanism between fountain roll 18 and a moisture transfer roll 26 having a hydrophilic surface. The transfer roll is in contact with a moisture form roll 28 having an oleophilic surface which runs in contact with master 14 on the surface of cylinder 12. A reciprocating distributor roll 30, likewise oleophilic, rides in contact with moisture form roll 28 and by a conventional internal cam mechanism shifts axially back and forth to level the ink layer and moisture deposit on the surface of roll 28 in a manner well known.

The surface of fountain roll 18 is hydrophilic and, preferably, is of a suitable metal, such as aluminum, or tin-nickel or chrome plating on an aluminum or steel support. Other hydrophilic materials, including non-metallic compositions, may be used as a surface material.

In many conventional systems, the ductor roll is covered with a molleton cloth which has certain moisture reservoir properties, and such a roll is not unsuitable for the purpose of the present invention. However, the preferred embodiment employs a ductor roll of synthetic elastomeric composition which has been disbursed with a high percentage of short fibers of suitable composition, such as regenerated cellulose, and which provides a matte surface. Such a composition is not significantly water absorptive and is adequately hydrophilic and oleophilic when wet and exhibits significant moisture attracting and carrying properties.

As mentioned above, the moisture transfer roll 26 is caused to oscillate axially as it is rotated through the driving force of roll 28. The control system of the present invention is provided with a microswitch 32, or other suitable sensor, which detects oscillations of the transfer roll and provides input signals to a moisture control circuit 34. Since the oscillation rate is directly related to the rotational speed of the transfer roll, the input signals to control circuit 34 are indicative of the rotational speed of the transfer roll. The moisture control circuit provides speed control signals to the fountain roll drive motor 20, whereby the speed of the motor is utilized to control the rate at which moisture is introduced into the duplicator system. It is important to note that transfer roll 26 serves as a moisture sensing roll, the rotational speed of which is indicative of the amount of moisture in the system. At a set machine speed, if sensing roll 26 speeds up, such is indicative of the need for additional moisture, and the speed of motor 20 is increased by moisture control circuit 34.

Form roll 28 is provided with a smooth rubber material on its surface which, preferably, is a synthetic elastomer having a durometer in the range of 20–40 on the Shore A scale. Roll 28 is driven in time with master cylinder 12, preferably by conventional gearing and in a manner which results in surface speeds which are approximately equal. Distributor roll 30 is oleophilic and remains inked up at all times during operation of the machine. Preferably, during the start up of the machine, light films of ink are placed on rolls 28 and 30. These rolls continue to receive ink since roll 28 runs in contact with the master which receives ink from an ink supply train (not illustrated).

As noted above, roll 30 oscillates axially to maintain the film at a uniform thickness at all times. The transfer or sensing roll 26 is driven solely by form roll 28. Under normal operation, roll 26 carries a film of moisture on its surface, which is supplied and continuously replenished by fountain roll 18 through ductor 22. As roll 26 rotates, it transfers a portion of the moisture film, via the ink layer on roll 28 to the surface of the master. It is thought that the transferred moisture, perhaps, in part forms an emulsion with at least the surface of the ink layer on roll 28 and in part produces a water film overlying the ink layer. Whatever the exact mechanism, however, moisture is indeed carried to the surface of the master by this composite layer of ink and moisture. While not necessarily required, the preferred embodiment provides roll 26 with a cam for axial reciprocation which improves the leveling action of the moisture deposit.

It has been discovered in connection with the present invention that roll 26 does not necessarily rotate at a constant surface speed in spite of the fact that roll 28 is driven at a substantially constant speed for a given machine speed. The variation in speed does, indeed, perform an important function in relation to the improved operation of the moisture control system.

It appears likely that the thickness of the moisture film on transfer roll 26, and more particularly, its thickness at the nip of rolls 26 and 28, is what controls the rotational speed of roll 26. If the moisture thickness increases, the torque necessary to generate shearing action in the film at the nip decreases so that the drive becomes less positive and roll 26 is caused to turn more slowly. On the other hand, as the moisture thickness decreases, the torque necessary to generate shearing action in the film increases so that the drive becomes more positive and roll 26 is caused to speed up. If roll 26 dries out completely, so as to receive its drive directly through the film of tacky lithographic ink on roll 28, its surface speed becomes approximately equal to that of roll 28. As the moisture layer is gradually increased, this results in a progressively slower rotation of the hydrophilic transfer roll 26, which appears to be directly responsive to the moisture thickness. This principle of slippage is disclosed in copending application Ser. No. 682,855 May 3, 1976, entitled LITHOGRAPHIC MOISTURE SYSTEM AND METHOD, incorporated herein by reference, filed in the name of the applicant of the instant application and assigned to the same assignee.

In order for roll 26 to slow down promptly as the moisture thickness increases (and driving torque decreases), there must be some form of load or retarding torque which increases monotonically as the speed of roll 28 increases (or, conversely, decreases as the speed of the roll decreases). While this would be very effective if the increase were directly proportional to speed, such is not a necessary requirement, and any suitable arrangement producing a significant increase in retarding torque with a corresponding increase in speed is thought to give an effective and fully operative result in terms of controlling the rotational speed of roll 26 to approximate inverse proportionality to the water film thickness. It is noted, however, that conventional bearing friction loading and the like, customarily present in machinery of this sort, normally provide a restraining torque fitting the above description.

In the preferred embodiment, retarding torque is provided in several forms. The bearings on the shaft supporting the trunnions of roll 26 present a significant retarding friction. In addition, ductor roll 22 which is in periodic contact with roll 26 is so adjusted that its arc of motion will tend to carry slightly beyond the point of surface contact and thereby produce a momentary interference pressure on the transfer roll. Other frictional components may contribute to the retarding torque as well, such as the friction of the standard cam drive arrangement utilized to effect reciprocation or oscillation of roll 26. Also, the viscous resistance generated by the composite layer of ink and moisture as roll 26 is reciprocated. The combined effects of these various loadings respond to the above description and provide a suitable type of restraining torque.

Certain of these retarding effects, particularly that of the ductor engagement, can be arranged to be mechanically adjustable by conventional means so as to provide for initial set-up of the system to produce optimum results. It will be appreciated, of course, that other means of creating the restraining torque may be utilized. For example, fluid dynamic means or electromagnetic braking may be applied to the shaft roll 26, or other restraint torque generating devices may be utilized.

When the system is initially set up for operation, the restraining torque to transfer roll 26 is adjusted by the assembler or serviceman to provide, in normal operation, a load sufficient to significantly reduce the surface speed of the transfer roll below that of the ink receptive roll 28. The transfer roll is normally set to run in a range of about 10–50% of the surface speed of roll 28. This may be determined by actual speed measurements. However, in the construction shown in the transfer roll 26 and distributor roll 30 are of about the same diameter and visual comparison of their speeds may be used to set the transfer roll speed within the indicated range.

It will be appreciated that with most conventional systems the operator makes adjustment in the moisture supply by increasing or decreasing the speed of the fountain roll. Generally, this is achieved by the setting of a conventional rachet mechanism which drives the roll at a selected speed ratio to the machine speed. If the setting made by the operator corresponds exactly to the amount of moisture being taken up by the surface of the master under the prevailing conditions, then there is proper operation and no flooding or starving occurs. Consequently, proper printed copy issued continuously from the duplicator. However, with most conventional moisture systems which are devoid of reservoir properties (i.e., the usual non-molleton systems) any deviation from the proper setting quickly shows up as flooding or weakening of the image if the moisture rate is too high, or starvation and the appearance of spreading, plugging and background if too low. Accordingly, the operator must be alert to observe copy quality and keep the system in proper balance by adjusting it periodically to accommodate changing conditions. As mentioned above, with the moisture control system of the present invention, the operator is relieved of these responsibilities as proper moisture balance within the system is maintained automatically and over a wide range of operating conditions.

Figure 2:
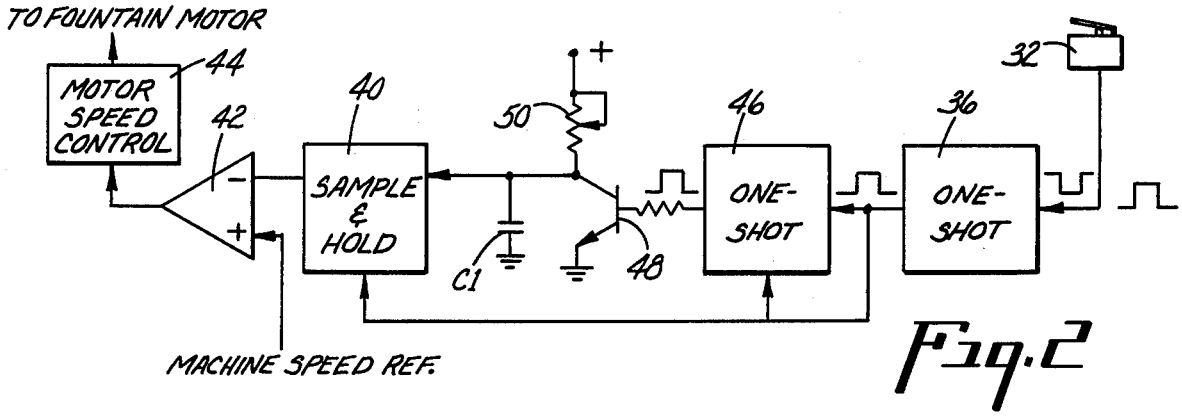
FIG. 2 is a block diagram of the moisture control circuit associated with the present invention.

General operation of the moisture control circuit will be described with reference to the block diagram illustrated in FIG. 2. Axial oscillation to transfer roll 26 causes periodic operation of microswitch 32, which produces a pulse for each oscillation. This triggers a first one-shot circuit 36 which produces a pulse of predetermined duration during which the voltage stored on capacitor C1 is sampled. In the preferred embodiment, the pulse from one-shot circuit 36 is approximately 10 msec. in duration. The voltage across capacitor C1 is stored by a sample and hold circuit 40 and appears as an output voltage which is applied to the negative input of an operational amplifier 42. A motor speed control 44 receives output signals from amplifier 42 to control the speed of the fountain motor 20.

The voltage charge on capacitor C1 is inversely related to the oscillation rate (rotational speed) of transfer or sensing roll 26. Thus, as the oscillation rate decreases, the voltage applied to the negative input of amplifier 42 increases, thereby causing a reduction in fountain roll speed, provided the machine speed has not been changed. Since the moisture required by the system is determined to a large extent by the speed of the duplicator, a machine speed reference signal is provided to the positive input of operational amplifier 42.

The output pulse from one-shot circuit 36 defines a sample period during which voltage from capacitor C1 is provided to the sample and hold circuit 40. At the end of the sample period, a second one-shot circuit 46 will be fired to generate a discharge pulse whereby the voltage on capacitor C1 will be discharged through a transistor 48. In the preferred embodiment the discharge pulse is approximately 5 msec. At the end of the discharge pulse, transistor 48 will be rendered non-conductive and capacitor C1 will begin recharging through an adjustable resistor 50. The capacitor will continue to charge for the duration of the next oscillation period of the transfer roll. The next operation of microswitch 32 will cause the charge voltage on capacitor C1 to be stored by the sample in hold circuit 40 and the above described process is repeated.

It will be appreciated that the moisture control circuitry provides a periodic monitor of the moisture condition for each oscillation of the transfer or sensing roll 26. If the oscillator frequency increases due to a reduction of water between rolls 26 and 28, the output from sample in hold circuit 40 will decrease, thereby causing the fountain roll to be driven at a higher speed. This adds moisture to the system necessary to return the oscillator frequency to its original value. Thus, the circuitry maintains a substantially constant ratio of oscillator frequency to machine speed. This ratio may be changed by adjusting the effective value of resistor 50 in the circuit.

Figure 4:
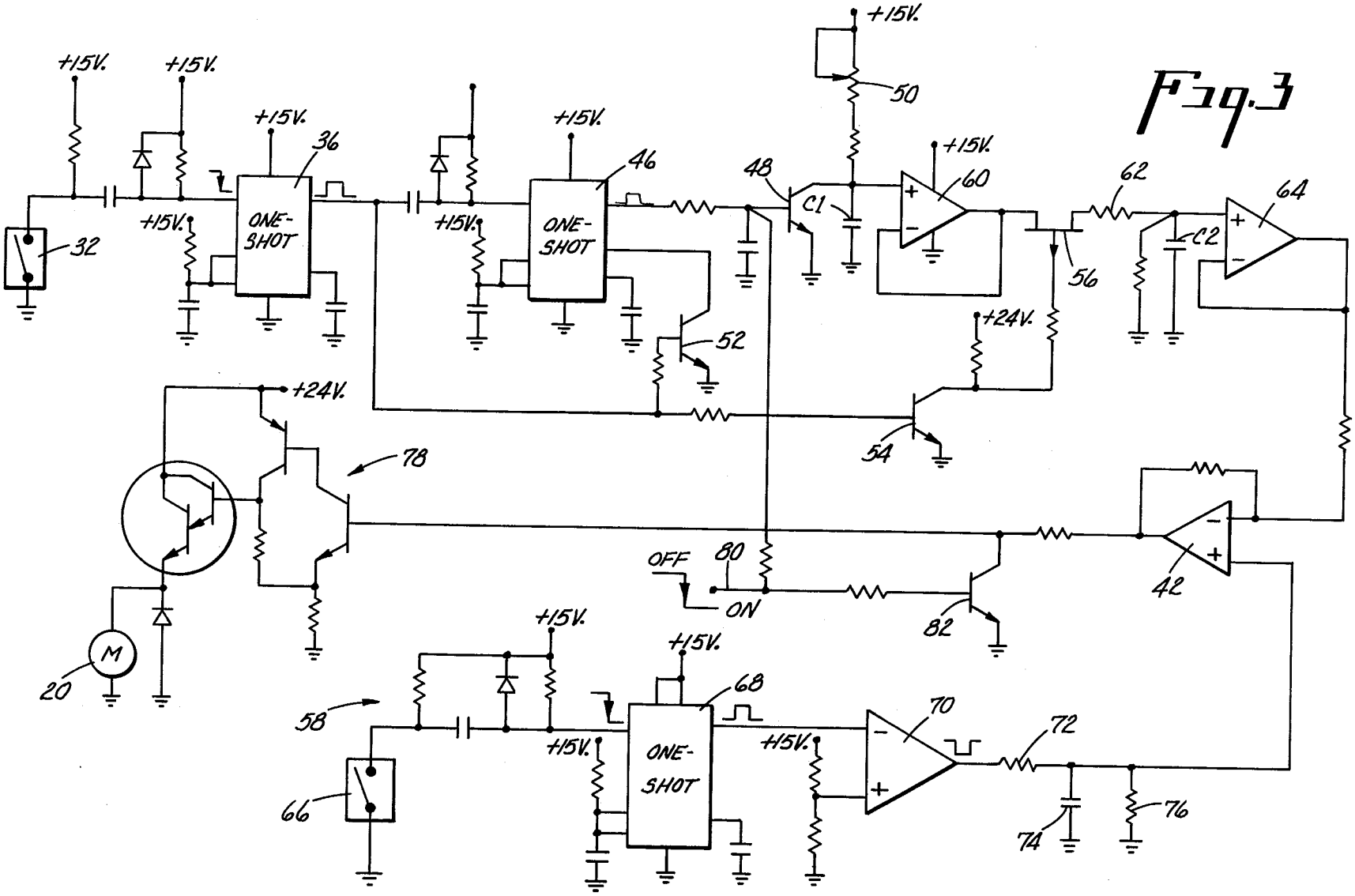
FIG. 4 is a timing diagram for various signals of the control circuit illustrated in FIG. 3.
Figure 4:
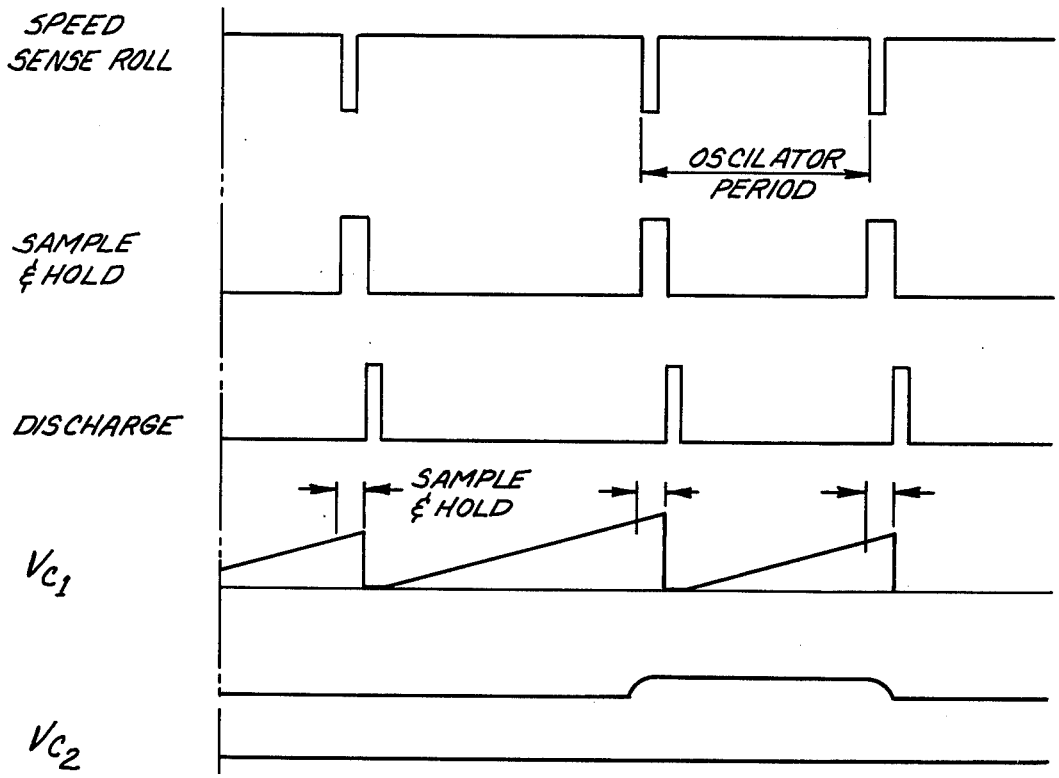
Figure 5:
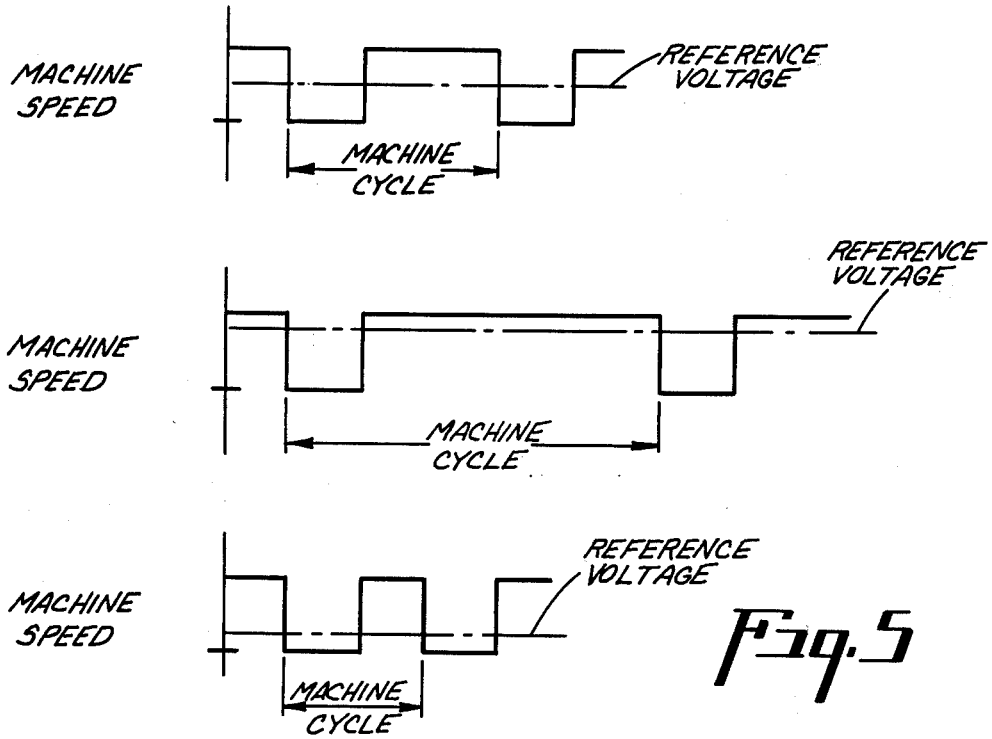
FIG. 5 is a diagram showing the machine speed pulses and resultant reference voltages under various operation conditions.

Referring to the schematic diagram of FIGS. 3, 4 and 5, operation of the circuitry may be understood in more detail. In the preferred embodiment, microswitch 32 is connected between ground at +15v. Closure of the switch causes a decrease in voltage to one-shot circuit 36 which provides a positive output pulse to the base of a transistor 52, the collector of which is connected to second one-shot circuit 46. Transistor 52 is rendered conductive to inhibit operation of one-shot circuit 46 during the duration of the sample pulse from one-shot circuit 36. The sample pulse also renders transistor 54 conductive, which in turn renders solid-state switch 56 conductive. During this time, the voltage previously built up on capacitor C1 is stored on a capacitor C2 through amplifier 60, switch 56 and resistor 62. Capacitor C2 is associated with the above-described sample and hold circuit and the voltage stored thereon is provided to the negative input of amplifier 42 through an amplifier 64.

Upon completion of the sample pulse from one-shot circuit 36, transistor 52 is rendered non-conductive, whereby one-shot circuit 46 fires. This provides a discharge pulse whereby capacitor C1 is discharged through transistor 48. Upon completion of the discharge pulse, capacitor C1 begins recharging and continues to charge until switch 32 is closed by completion of the next oscillation of sensing roll 26.

The machine speed reference signals to amplifier 42 are provided by a circuit generally indicated by the numeral 58. A microswitch 66, or the equivalent, is closed on each revolution of the master cylinder. Closure of microswitch 66 triggers a one-shot circuit 68 which provides an output pulse of predetermined duration to the negative input of an amplifier 70. In the preferred embodiment, the pulse is approximately 0.165 sec. in duration. The positive input to amplifier 70 is connected to a +15 v. through a voltage divider circuit. Thus, amplifier 70 provides a negative output pulse of duration equal to that of the pulse from one-shot circuit 68.

A resistor 72 at the output of amplifier 70, together with a capacitor 74, define an RC integration circuit which averages the pulses to provide a reference voltage indicative of the duplicator speed. A resistor 76 is provided for bleeding off capacitor 74 when the machine is not in operation. The speed reference voltage signal is applied for the positive input of amplifier 42 which is connected to provide low gain and serves as a differential amplifier for the two input signals.

FIG. 5 illustrates the function of the RC integration circuit in providing the machine speed reference voltage signals. As mentioned above, a pulse is provided for each machine cycle as the pulses (which are negative) get closer together, the resultant reference voltage is decreased. The three diagrams of FIG. 5 illustrate this principal. When the machine is slowed down, the machine speed pulses become further apart. The reference voltages increases as illustrated in the second diagram. On the other hand, as the machine speed increases, the pulses become closer together and the reference voltage is decreased.

It will be appreciated that changes in the reference voltage are not exactly linear with changes in machine speed. Also, changes in the moisture sheer forces and evaporation rate are slightly non-linear with changes in machine speed. By selecting an appropriate width for the machine speed pulses and by suitably tailoring the gain characteristics of the operational amplifier, the effects of these non-linearities are substantially eliminated. Therefore, the machine speed may be changed significantly without need to adjust resistor 50.

The output of amplifier 42 provides a motor drive signal which is applied to a power amplifier generally indicated by the numeral 78. The resultant signals are utilized to drive the moisture fountain motor 20 at a speed dictated by the control.

The moisture control circuitry is disabled when the machine motor is off. This is achieved through signals applied to line 80. When the machine motor is not running the input to line 80 is held high, causing transistor 82 to conduct. This prevents the motor drive signals from reaching power amplifier 78. Also, transistor 48 is caused to conduct, whereby capacitor C1 is discharged in preparation for recharging when the machine is turned on.

Figure 6:
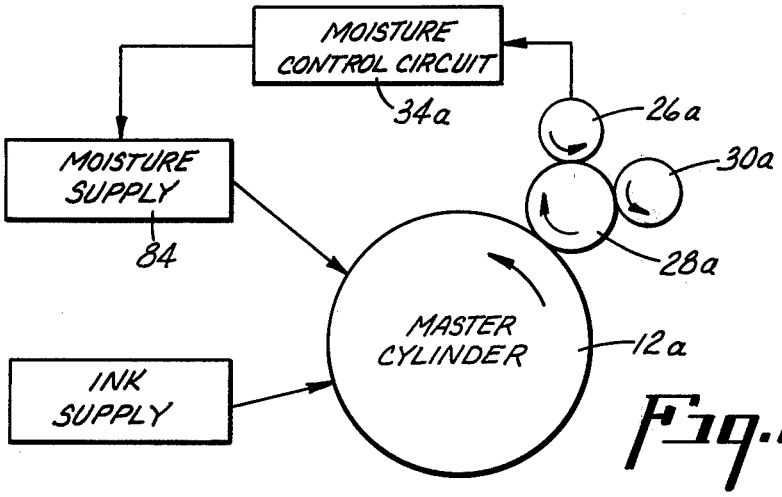
FIG. 6 is a simplified diagrammatic illustration of a second embodiment of the present invention.

It will be appreciated that since the transfer roll utilized to sense the moisture in the system is disposed in the moisture supply train, the system responds very rapidly to changes in moisture. Depending upon the duplicator and anticipated operating conditions, rapid response may not be critical to maintaining proper moisture balance in the system. Accordingly, it may be practical to sense the moisture in the system at a location separate from the moisture supply train. Such an arrangement is illustrated in FIG. 6 of the drawings. In this embodiment of the invention moisture is furnished to the system by an appropriate supply 84 which may or may not be similar to that shown in FIG. 1. Moisture introduced into the system migrates to a form roll **28*a* via master cylinder 12*a*. The form roll is of the type described above with reference to FIG. 1. The moisture picked up by roll 28*a* migrates to the nip of a hydrophilic roll 26*a*, similar to roll 26 described above. An oscillating ink roll 30*a* may be provided for uniformly distributing the ink. The speed of sensing roll 26*a* is used to provide signals to a moisture control circuit 34*a*,** the output of which controls the rate at which moisture is introduced into the system. Operation of this embodiment of the invention is similar to that described above, wherein an increase or decrease in moisture in the system causes a corresponding decrease and increase in the speed of the transfer roll.

Of course, it is not intended that the present invention be limited to the circuitry illustrated in the drawings and described above. Various circuits may be utilized to provide motor speed signals to the fountain roll which are indicative of the moisture in the system. Also, various types of sensors may be used to provide signal indicative of the speed of transfer roll 26. Optical detectors and other devices well known to those skilled in the art may be utilized, if desired. Furthermore, it is not essential that the transfer roll 26 oscillate axially as described above, although it has been found that this aids in uniform distribution of the ink and moisture at the interface with form roll 28. It is conceivable that the transfer roll's motion be purely rotary and that appropriate means be provided for producing signals indicative of the rotational speed. This could take the form of a microswitch which is actuated upon each revolution of the transfer roll.

What is claimed is:

1. A moisture system for a lithographic duplicator having a rotary master-carrying cylinder comprising:

a moisture sensing roll with a hydrophilic surface, means for carrying moisture between said sensing roll and the surface of a master on the master cylinder including a roll with an ink-receptive surface, means for maintaining on the surface of said ink-receptive roll a continuous film of lithographic ink, means for driving said ink-receptive roll in a predetermined time relationship with the master cylinder of the duplicator, means for presenting a supply of moisture to the ambit of said sensing roll surface at a controlled rate, means for maintaining said sensing roll in nip-forming driven surface contact with said ink-receptive roll with the ink-receptive roll providing, through the medium of the ink and moisture at said nip, the sole driving agent for said moisture sensing roll, whereby the rotational speed thereof is dependent upon the extent of moisture appearing at the nip, and control means operatively connected to said sensing roll for controlling the rate at which moisture is supplied by said moisture supply means as a function of the rotational speed of said moisture sensing roll.

2. The system set forth in claim 1 wherein said control means includes means for sensing operation of said moisture sensing roll and providing signals indicative of the rotational speed of said sensing roll, whereby moisture is supplied by said moisture supply means in response to said roll speed signals.

3. The system set forth in claim 2 wherein said moisture supply means comprises:

a moisture fountain, a rotatable fountain roll running in contact with the liquid in said fountain, and drive means for rotating said fountain roll, said control means including means for controlling the speed of said drive means as a function of said roll speed signals.

4. The system set forth in claim 3 wherein said control means includes means for providing reference signals indicative of the speed of the duplicator, said speed control means controlling the speed of said drive means as a function of both said reference signals and said roll speed signals.

5. The system set forth in claim 4 wherein said moisture supply means includes a freely rotating ductor roll and means for oscillating the same to alternatively contact said fountain roll and said sensing roll.

6. The system set forth in claim 2 wherein said control means includes means for providing reference signals indicative of the speed of the duplicator, said moisture supply means being responsive to both said reference signals and said roll speed signals to supply moisture at a functionally related rate.

7. The system set forth in claim 6 wherein said moisture supply means comprises:

a moisture fountain, a rotatable fountain roll running in contact with the liquid in said fountain, and drive means for rotating said fountain roll, said control means including means for controlling the speed of said drive means as a function of said roll speed signals and said reference signals.

8. The system set forth in claim 7 wherein said moisture supply means includes a freely rotating ductor roll and means for oscillating the same to alternately contact said fountain roll and said sensing roll.

9. The system set forth in claim 8 wherein said moisture sensing roll is provided with means for causing axial reciprocation of the sensing roll, said sensing means sensing said reciprocation.

10. The system set forth in claim 9 wherein there is provided means for exerting on said sensing roll a retarding torque which increases and decreases with the speed of rotation of said sensing roll.

11. The system set forth in claim 1 wherein said control means maintains a substantially constant ratio of the rotational speed of said moisture sensing roll to the rotational speed of said master cylinder for any selected master cylinder speed within a predetermined speed range.

12. A moisture system for a lithographic duplicator having a rotary master-carrying cylinder comprising:

a moisture sensing roll with a hydrophilic surface, means for carrying moisture between said sensing roll and the surface of a master on the master cylinder including a roll with an ink-receptive surface, means for maintaining on the surface of said ink-receptive roll a continuous film of lithographic ink, means for driving said ink-receptive roll in a predetermined time relationship with the master cylinder of the duplicator, means for supplying moisture to said master at a controlled rate, means for maintaining said sensing roll in nip-forming driven surface contact with said ink-receptive roll with the ink-receptive roll providing, through the medium of the ink and moisture at said nip, the sole driving agent for said moisture sensing roll, whereby the rotational speed thereof is dependent upon the extent of moisture appearing at the nip, and control means operatively connected to said sensing roll for controlling the rate at which moisture is supplied by said moisture supply means as a function of the rotational speed of said moisture sensing roll.

13. The system set forth in claim 12 wherein said control means includes means for sensing operation of said moisture sensing roll and providing signals indicative of the rotational speed of said sensing roll, whereby moisture is supplied by said moisture supply means as a function of said roll speed signals.

14. The system set forth in claim 13 wherein said moisture supply means comprises:

a moisture fountain, a rotatable fountain roll running in contact with the liquid in said fountain, and drive means for rotating said fountain roll, said control means including means for controlling the speed of drive means as a function of said roll speed signals.

15. The system set forth in claim 14 wherein said control means includes means for providing reference signals indicative of the speed of the duplicator, said speed control means controlling the speed of said drive means as a function of both said reference signals and said roll speed signals.

16. The system set forth in claim 15 wherein said moisture supply means includes means for transferring moisture from said fountain roll to said master.

17. The system set forth in claim 13 wherein said control means includes means for providing reference signals indicative of the speed of the duplicator, said moisture supply means being responsive to both said reference signals and said roll speed signals to supply moisture at a functionally related rate.

18. The system set forth in claim 17 wherein said moisture supply means comprises:

a moisture fountain, a rotatable fountain roll running in contact with the liquid in said fountain, and drive means for rotating said fountain roll, said control means including means for controlling the speed of said drive means as a function of said roll speed signals and said reference signals.

19. The system set forth in claim 18 wherein said moisture supply means includes means for transferring moisture from said fountain roll to said master.

20. The system set forth in claim 19 wherein said moisture sensing roll is provided with means for causing axial reciprocation of the sensing roll, said sensing means sensing said reciprocation.

21. The system set forth in claim 12 wherein said control means maintains a substantially constant ratio of the rotational speed of said moisture sensing roll to the rotational speed of said master cylinder for any selected master cylinder speed within a predetermined speed range.

22. A method for providing moisture to the master cylinder of a lithographic duplicator comprising the steps of:

providing, at least as part of a roll train having contact with the master surface, an ink-covered roll and positively driving the same in time with the master cylinder;

placing a hydrophilic transfer roll in driven, nip-forming, surface contact with the ink-covered roll and allowing the hydrophilic roll to be driven solely by its thus established driven connection with the ink-covered roll;

making available to the ambit of the transfer roll surface an adjustably controlled rate of supply moisture;

sensing the speed of the transfer roll; and adjusting the moisture supply rate in accordance with the sensed transfer roll speed.

23. A method as set forth in claim 22 which includes applying a controlled retarding torque resisting rotation of the transfer roll, which torque is increased and decreased in accordance with the increase or decrease in the speed of rotation of the transfer roll.

* * * * *